US007594295B2

(12) United States Patent
Marcil et al.

(10) Patent No.: US 7,594,295 B2
(45) Date of Patent: Sep. 29, 2009

(54) AUXILIARY VACUUM UNIT FOR A CENTRAL VACUUM CLEANING SYSTEM

(75) Inventors: Christian Marcil, Vaudreuil-Dorion (CA); Urs Widmer, St-Chrysostôme (CA)

(73) Assignee: Widmar Inc., St-Chrysostome, QC (CA)

( * ) Notice: Subject to any disclaimer, the term of this patent is extended or adjusted under 35 U.S.C. 154(b) by 0 days.

(21) Appl. No.: 12/232,939

(22) Filed: Sep. 26, 2008

(65) Prior Publication Data

US 2009/0083930 A1 Apr. 2, 2009

Related U.S. Application Data

(60) Provisional application No. 60/975,856, filed on Sep. 28, 2007.

(51) Int. Cl.
*A47L 5/38* (2006.01)
*A47L 15/00* (2006.01)

(52) U.S. Cl. ..... 15/301; 15/315

(58) Field of Classification Search ..... 15/301, 15/314, 315; *A47L 5/38, 15/00*
See application file for complete search history.

(56) References Cited

U.S. PATENT DOCUMENTS 3,283,093 A * 11/1966 Bishop ..... 15/301
6,459,056 B1 * 10/2002 Graham ..... 200/61.6
7,328,478 B2 * 2/2008 Jenkins ..... 15/301
2007/0256269 A1 11/2007 Pagni
2008/0092323 A1 4/2008 Smith et al.

* cited by examiner

*Primary Examiner*—David A Redding
(74) *Attorney, Agent, or Firm*—Equinox Protection; Franz Bonsang, Patent Agent

(57) ABSTRACT

An auxiliary vacuum device for a central vacuum cleaning system is location specific and comprises a housing mountable externally on an inlet of a mounting plate of the system, a dedicated flexible concertina hose is provided on the device and a cleaning tool mounting probe is registrable with a docking station. With the probe docked in the docking station the device is in the 'off' position and with the probe removed therefrom the device is in the 'off/standby' mode. A push on/off button is used to complete the procedure for starting the system and for stopping it in an 'off/standby' mode.

15 Claims, 7 Drawing Sheets

AUXILIARY VACUUM UNIT FOR A CENTRAL VACUUM CLEANING SYSTEM

CROSS REFERENCE TO RELATED APPLICATIONS

Benefit of U.S. Provisional Application for Patent Ser. No. 60/975,856, filed on Sep. 28, 2007, is hereby claimed.

FIELD OF THE INVENTION

The present invention relates in general to a central vacuum cleaning system and more particularly to an auxiliary unit for attachment to the central vacuum cleaning system.

BACKGROUND OF THE INVENTION

Central vacuum cleaning systems are well known and are to be found in domestic and commercial premises to provide a centralized cleaning regime based on the vacuum cleaner principle to minimize the carriage of conventional equipment from place to place. Naturally, there are available small portable vacuum cleaners operable independently of the central vacuum system, which may easily be transported manually from location to location within domestic or commercial premises, but generally their power is restricted by the need to afford portability.

It is normal in a central vacuum cleaning system, for example as deployed in a condominium, to site a few strategically placed connection stations, coupled in a circuit to a central vacuum generating unit, and to provide a flexible hose of not inconsiderable length for registration with one station enabling cleaning of a number of rooms and areas to be achieved with that one length of hose. The length of the hose makes laborious the task of vacuuming in view of the need to carry such an unwieldy and relatively heavy mass of hose between stations.

Various proposals to alleviate this problem have been made. For example, US Patent Application Publication No. US 2007/0256269 to Pagni discloses a location specific unit integral with the fabric of the building in which it is to be employed, namely within the wall structure. However, this proposal merely provides a vacuum system for each cleaning area, rather than a central vacuum system with a number of outlets throughout the building.

Another example of prior art is to be found in US Patent Application Publication No. US 2008/0092323 to Smith et al who describe a central vacuum cleaning system as such with wall valves in the various rooms of a building structure and one cabinet housing cleaning tools including a flexible hose connected into the central system through a wall valve within the cabinet, which again is mounted within a stud wall.

There are other systems which provide for a similar arrangement as in the Smith et al proposal but with a free-standing cabinet, for example in a kitchen, housing an appropriate suction tool on a hose connected permanently to an inlet of the central vacuum cleaning system. Removal of the tool from a specially designed docking station, incorporating a switching arrangement, activates the vacuuming mode with replacement of the tool causing deactivation. A disadvantage of such a system is it always requires the opening of a cabinet door before reaching the cleaning tool, and the door remains open during operation of the system, which might be highly cumbersome.

Although the prior art suggests the need to make central vacuum cleaning systems more location specific to facilitate the cleaning operation, a disadvantage of the thereof is the requirement to include the facility within the structure of the building serviced by the central vacuum cleaning system.

Accordingly, there is a need for an auxiliary vacuum device for use with a central vacuum cleaning system.

SUMMARY OF THE INVENTION

It is therefore a general object of the present invention to provide an auxiliary vacuum device for use with a central vacuum cleaning system.

An advantage of the present invention is that the auxiliary vacuum device is location specific in relation to the central vacuum cleaning system, especially where cleaning/vacuuming is frequently required such as in the laundry room for the dryer filter, in the main entrance area, or even in close proximity to a pet litter box or the like.

A further advantage of the present invention is that the auxiliary vacuum device is mountable externally of the structure of the building in which the system is installed on a standard inlet mounting plate the same type used to install a conventional inlet valve.

A more specific advantage of the present invention is that such an auxiliary vacuum device incorporates a manageable length of flexible hose permanently associated with the system.

A still further advantage of the present invention is that the auxiliary vacuum device is so designed for quick, easy and safe usage, by having a standard sized tapered sealing component (docking station and probe), and by the fact that the standard sized probe is capable of receiving standard cleaning accessories for different cleaning tasks.

As other advantages of the present invention, when the probe of the auxiliary vacuum device is docked/sealed it allows other inlet stations to be used in the central vacuum cleaning system, and the switching mechanism is so designed as to avoid startup if the probe is installed in the docking station, thus protecting the central vacuum cleaning system motor from harmful overloading. The present unit is also automatically turned off as soon as the probe is inserted back into the docking station after usage.

Another advantage of the present invention is that the auxiliary vacuum device is that the unit includes an independent on/off switch for local operation and safety purposes. When the probe is removed from docking station the operator must manually press the on/off button to allow central vacuum cleaning system to start. Should the operator have to stop the central vacuum cleaning system for any reason he can do so by simply repressing the on/off button.

Yet another advantage of the present invention is that the auxiliary vacuum device is that the housing is so designed that the hose could be of various lengths and different types for example extruded or extruded electric hose with on/off switch, etc. The body upper edge can wind one turn of hose. The hose is removable from the device in order to be replaced or repaired.

According to the invention an auxiliary vacuum device for a central vacuum cleaning system for premises defining areas of occupancy, said system including an electrically powered vacuum generating unit, a system network of piping extending throughout the premises and terminating in at least one inlet formed in one of the walls defining at least some of the areas of occupancy, the device comprising a housing for registration with an inlet extending through a mounting plate of the system network, the housing being adapted for installation at the inlet mounting plate externally of the wall and being provided with an inlet port for communication with said inlet, a connection exterior to the housing, a pipe extending within the housing from the inlet port to said connection, a flexible concertina hose attached to the connection proximal to the housing, a cleaning tool mounting probe provided on the hose distal from the connection, a docking station in the housing for the cleaning tool mounting probe, and switch mechanism located within the housing and adapted for activating and de-activating the electrically powered vacuum generating unit of the central vacuum cleaning system.

The docking station of the housing serves as a friction type sealing component and is provided with a contact member forming part of the switch mechanism for interaction as between the cleaning tool mounting probe and another part of the switch mechanism whereby in use the removal of the probe initiates a first phase of the activation of the vacuum generating unit and re-insertion thereof causes de-activation of the unit. The contact member may conveniently be in the form of a cam provided on a pivotally mounted rocker arm. The rocker arm has formed therein a slot for receiving a stub shaft carried by a pivotally mounted guide arm. Both the rocker arm and the guide arm are pivotally mounted on a back plate of the housing and form part of the switch mechanism.

The auxiliary vacuum device is further characterized by the provision of an on/off button for depression in order to initiate a second phase of the activation of the vacuum generating unit or de-activate the vacuum generating unit of the central vacuum cleaning system. The on/off button includes a push rod.

The push rod itself carries a cam formation or contoured surface which selectively contacts the guide arm and causes said rotational movement.

A track, also forming part of the switch mechanism, is carried by another plate also pivotally mounted on the back plate and is resiliently biased with respect thereto, via a track torsion spring, in a direction allowing the follower pin to move along predetermined sections of the track toward the 'off/standby' position.

The rocker arm carries a follower pin engaging with the track which provides a tortuous path (formed by different sections) therefor, the movement of the pin within the track being occasioned by the interaction of track torsion spring, the rocker arm carrying the cam and the guide arm, which has an abutment for a torsion spring extending from an electrical contact on the back plate of the housing, then around the pivot of the guide arm and thence to the abutment whereby the guide arm is biased in an anti-clockwise direction. The torsion spring also constitutes an electrical path from the electrical contact to the guide arm and biases the guide arm in a direction toward enabling the torsion spring to get into contact with the other electrical contact. The interengagement of the stub shaft on the guide arm and the slot in the rocker arm and the bias of the torsion spring give the rocker arm and thus the pin thereon a bias in a clockwise sense.

The guide arm further comprises a contact recess allowing partial exposition of the torsion spring with which is engageable by another pole electrical contact mounted to the back plate of the housing. Suitable electrical power cables are provided for the electrical contacts mentioned supra.

The tortuous path provided by the track defines 'off', 'off-standby' and 'on' positions of the switch mechanism. The face of the track is contoured to ensure positive location of the pin in the various positions defined therein and to prevent any error in pin positioning within the track.

In use, removal of the cleaning tool mounting probe allows the pin to move along the track from the 'off' position and to snap into the 'off/standby' position under the influence of the torsion spring bias. Actuation of the on/off button rotates the guide arm and the rocker arm to allow the pin to travel from the 'off/stand by' position and to snap into the 'on' position with the electrical contact engaging the recess in the guide arm and allowing contact between the two terminals via the torsion spring to electrically close the circuit thus initiating the vacuum generating unit with suction being applied to the flexible hose, which may carry a suitable tool for the cleaning job in hand. The power may be interrupted by replacement of the cleaning tool mounting probe into the docking station thus causing the rocker arm to rotate anti-clockwise and to move the follower pin to the 'off' position, the contact opening away from the recess in the guide arm. In the alternative, the on/off button may again be depressed thus allowing the guide arm and the track to rotate clockwise thus causing the pin to slide within the track to the 'off' position.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiment of the present invention will be herein described for indicative purpose and by no means as of limitation.

Figure 1:
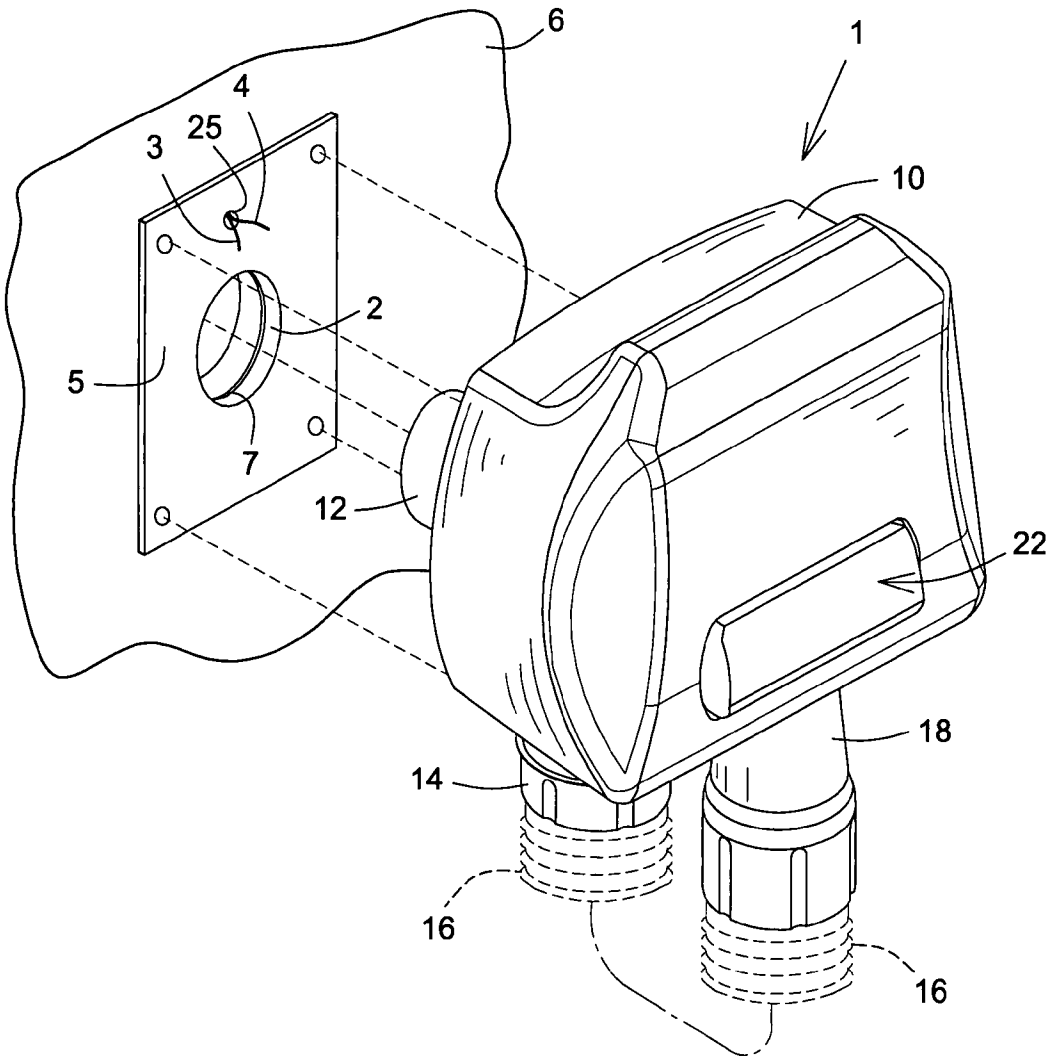
FIG. 1 is an isometric view of an auxiliary vacuum device in accordance with an embodiment of the present invention showing the device aligned for external mounting to a standard inlet mounting plate of a central vacuum cleaning system.

In FIG. 1 there is illustrated an auxiliary vacuum device 1 which is mountable on a standard inlet mounting plate 5 which incorporates an inlet opening 2 of a central vacuum cleaning system (not shown) which incorporates an electrically powered vacuum generating unit the operation of which is controlled by the device in the manner hereinafter defined. Suitable low voltage electrical wires 3, 4 are provided and protrude from the standard inlet mounting plate 5 which is installed in a wall 6 of the premises in which the central vacuum cleaning system is installed. The device 1 comprises inter alia a housing 10 provided with an inlet port 12 for registration and flow communication with the standard inlet opening 2, typically provided with a seal member such as an O-ring 7 or the like. The housing 10 encases a typically 90-degree elbow pipe 13 (FIGS. 3, 5, and 7) which interconnects the inlet port 12 with a connection 14 external to the housing 10 for a flexible concertina hose 16. At the end of the hose 16 distal from the connection 14 is a cleaning tool mounting probe 18 which may be parked in a docking station 20 (FIG. 3) formed in the housing 10. An on/off push button 22 is provided on the housing 10 which itself is mounted to the wall 6 externally thereof and not integral with the standard inlet mounting plate 5.

Figure 2:
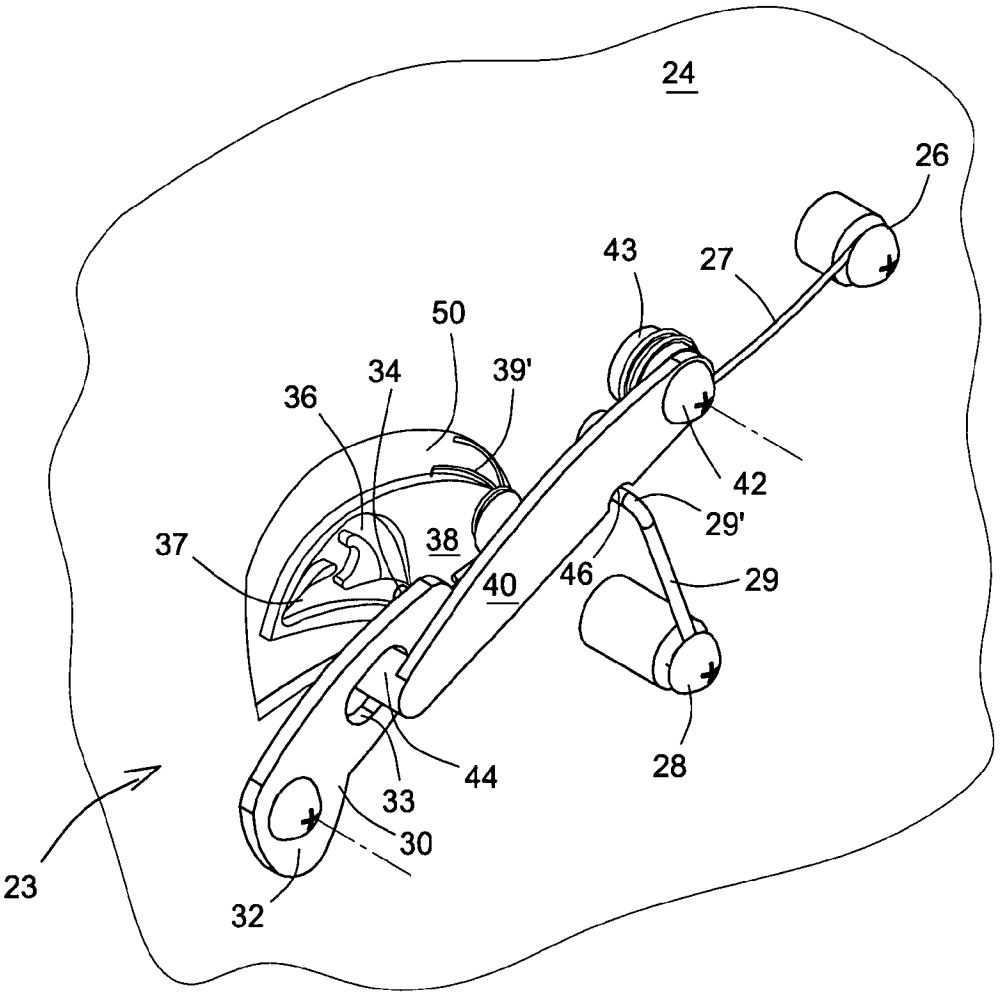
FIG. 2 is an enlarged partial perspective view of some details of the switch mechanism.
Figure 2A:
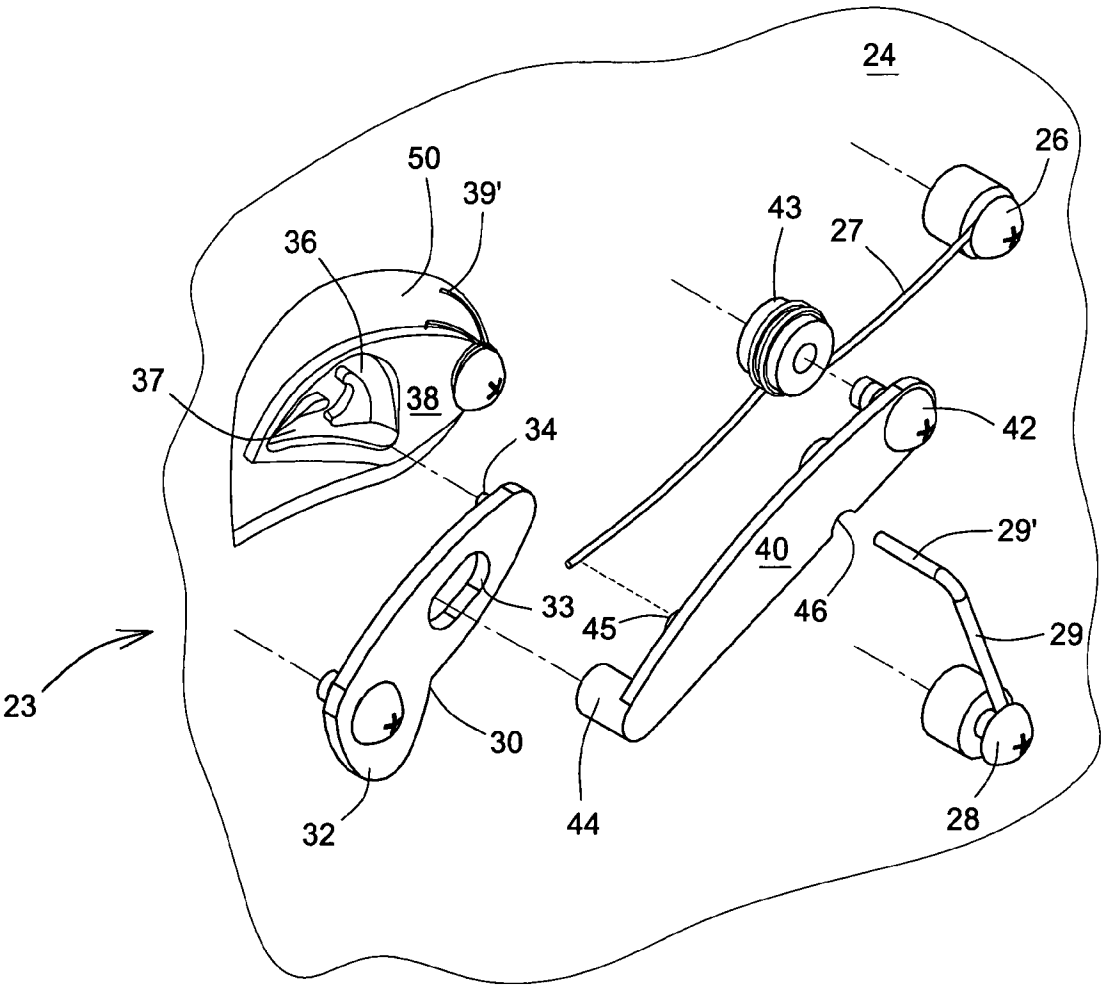
FIG. 2*a* is an exploded view of the details illustrated in FIG. 2.
Figure 4:
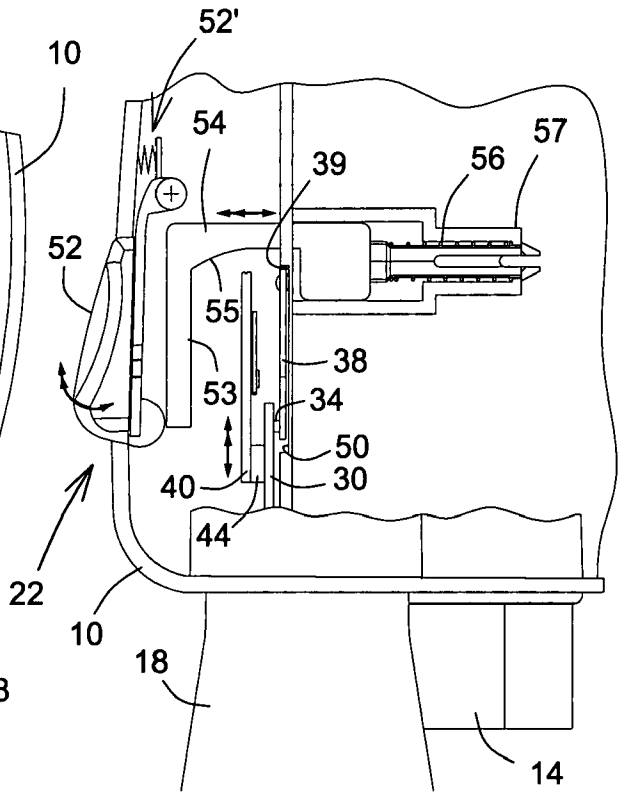
FIG. 4 is a partially broken schematic side view of the device shown in FIG. 3 with some parts removed for the sake of clarity.

FIGS. 2, 2*a* show some of the mechanical details of the switch mechanism 23 encased within the housing 10. A back plate 24 of the housing 10 is shown with two electrical low voltage terminals 26, 28 screw mounted to the plate 24 through which the wires 3, 4 are fed from the back via hole 25 and securely held by the screw mounts in conventional manner. The terminal 26 provides a contact point for a torsion spring 27, whilst the terminal 28 provides a mount for a contact arm 29 having bent portion 29'.

Figure 3:
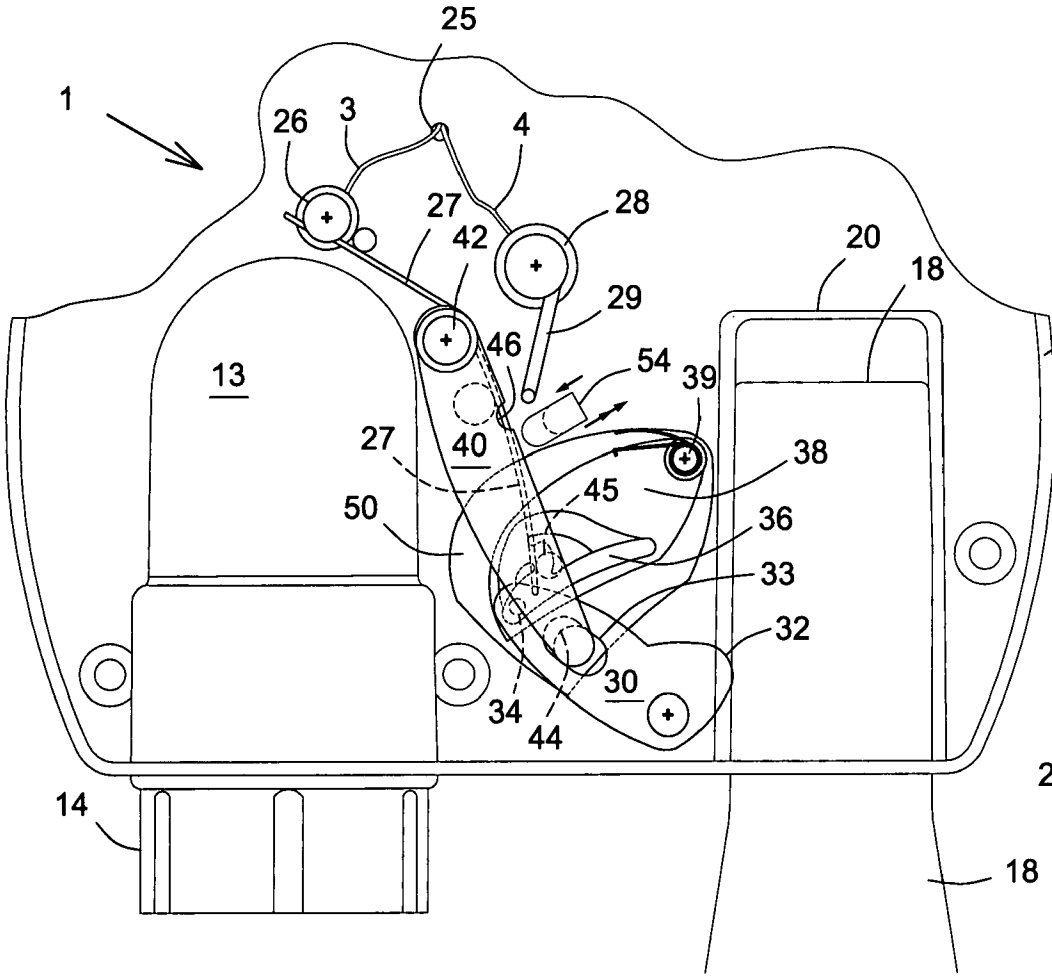
FIG. 3 is a partially broken internal view of the device showing the device in the 'off' position with the cleaning tool mounting probe in the docking station.
Figure 6:
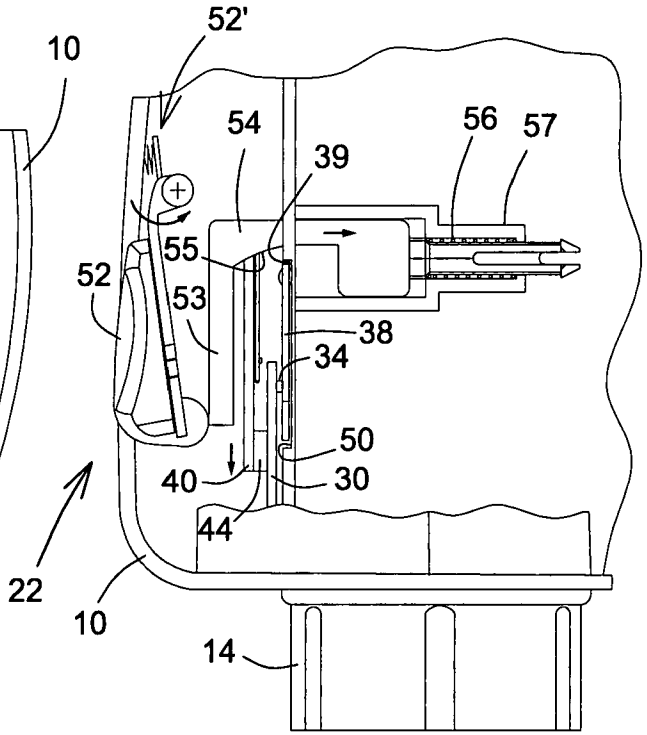
FIG. 6 is a partially broken schematic side view of the device shown in FIG. 5 with some parts removed for the sake of clarity and with the on/off button having been depressed.
Figure 5:
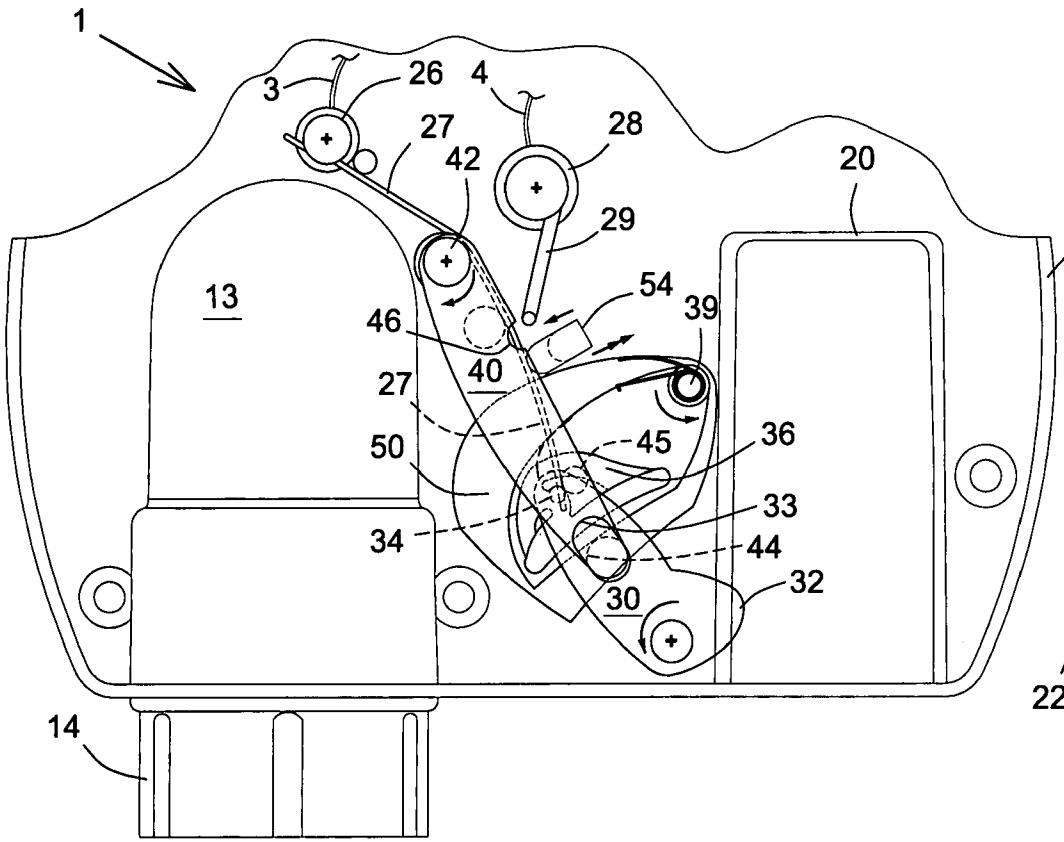
FIG. 5 is a partially broken internal view of the device of FIG. 3 showing the device in the 'off/standby' position with the cleaning tool mounting probe removed from its docking station.
Figure 8:
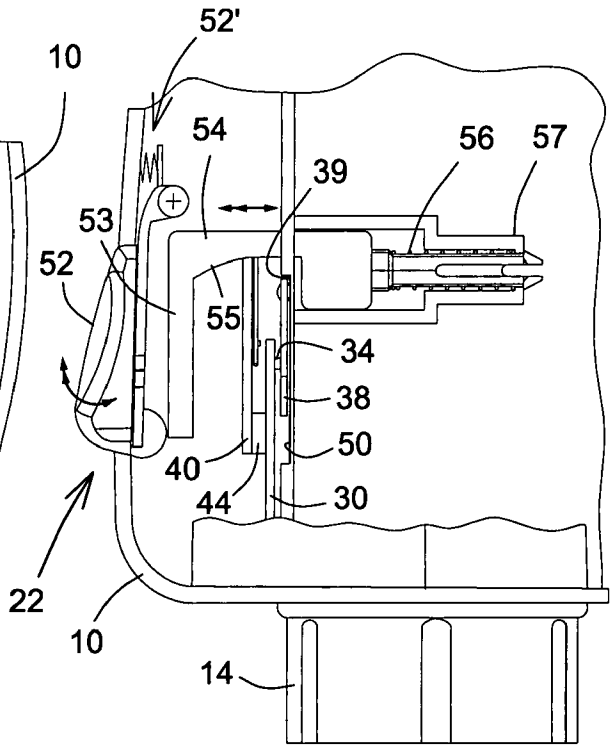
FIG. 8 is a partially broken schematic side view of the device shown in FIG. 7 with some parts removed for the sake of clarity and showing the on/off button following further depression thereof.
Figure 7:
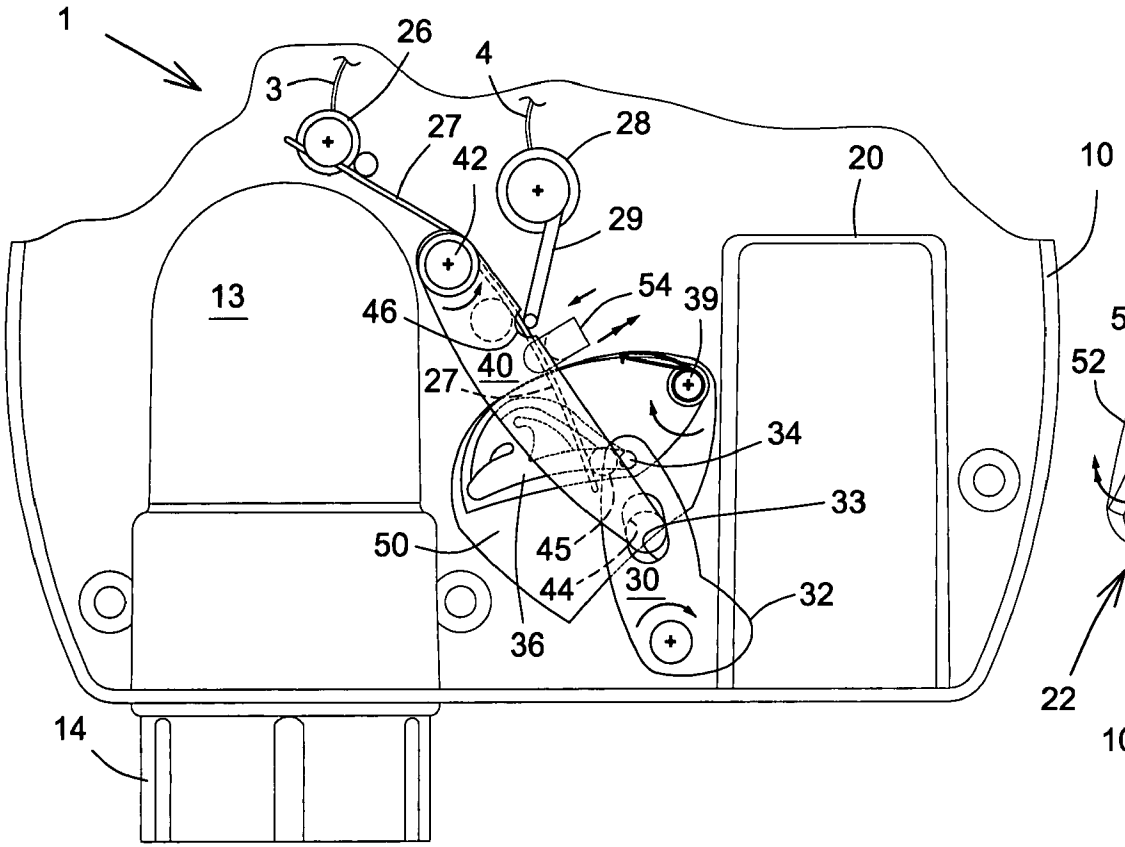
FIG. 7 is a partially broken internal view of the device of FIG. 3 illustrating the device in the 'on' position following the depression of the on/off button as seen in FIG. 6.

A rocker arm 30 is pivotally mounted on the back plate 24 of the housing 10 and carries a cam 32 which protrudes into the docking station 20 of the cleaning tool mounting probe 18 as can more clearly be seen in FIGS. 3, 5, and 7. An arm slot 33 is formed in the rocker arm 30 which also carries a follower pin 34 for engagement in a track 36 formed in the face of a track plate 38 which is pivoted at point 39 to the back plate 24 of the housing 10. The floor 37 of the track 36 is contoured to some extent for a purpose hereinafter explained.

A guide arm 40 is pivotally mounted at 42 at one end thereof to the back plate 24 of the housing 10 and carries at its other end remote from pivot 42 a stub shaft 44 engageable with the rocker arm 30 at slot 33. The pivot 42 of the arm 40 is received in an insulated bush mounting 43 (not required when the housing is molded out in a plastic material already an electrical insulator) around which the torsion spring 27 is reeved. The torsion spring 27 extends from the terminal 26 to contact an abutment 45 on the guide arm 40 which is provided with a recess 46 for exposing the torsion spring in register with, and receiving the bent portion 29' of the contact arm 29 fixed to the terminal 28. The assembled parts as shown in FIG. 2 demonstrate that the torsion spring 27 biases the rocker arm 30 in a clockwise sense while the guide arm 40 is biased in the opposite sense (direction).

The track plate 38 located in a back plate recess 50 and pivoting at 39 is biased in relation thereto via a track torsion spring 39', the plate 38 being biased in a counter clockwise sense.

As can more clearly be seen from FIGS. 3 to 8 which are orthogonal views, the on/off push button 22 includes a swing cover 52 spring loaded as at 52' and operable against a striker bar 53 connected to a push rod 54 suitably spring loaded as at 56 within a casing 57. The push rod 54 is contoured on its lower surface 55 for selective contact with the guide arm 40 which is pivotal about the point 42.

In operation, the auxiliary vacuum device is mounted externally on the wall 6 on the standard mounting plate 5 of a central vacuum cleaning system which provides a piping network (not shown) extending to strategic cleaning points throughout the premises. The system includes an electrically powered vacuum generating unit connected to the network and operable upon demand by the actuation of the device 1 which is location specific within the premises. For example in domestic premises where there is likely to be a heavy cleaning burden, e.g. the main entrance, laundry room or the garage, an inlet would be provided as would a device dedicated to that location. The length of the flexible concertina hose 16 may be of the order of up to 1.5 meters extensible to 6 meters, thus providing a local hose of manageable length for the location concerned.

Figure 9A:
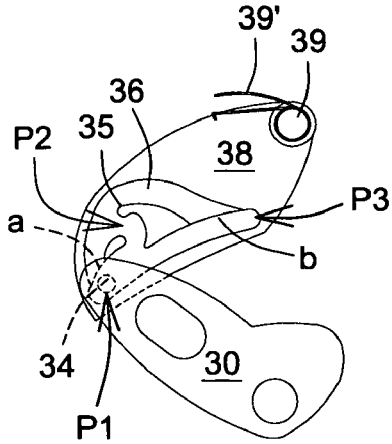
FIGS. 9*a* to 9*f* are schematic illustrations of the various phases of operation of the switch mechanism of the auxiliary vacuum device of the present invention showing the track and the position and displacements of the pin therewithin the corresponding phases.

In the non-operational mode of the central vacuum cleaning system, the probe 18 is placed firmly by frictional sealing contact, via a tapered of conical shape thereof within the docking station 20 (FIG. 3) with the follower pin 34 within the track 36 at the 'off' position P1 in FIG. 9*a*, as to provide a closed state of the pipe when not used, to allow proper functioning of the central vacuum cleaning system (via another standard mounting plate with is inlet valve located at any other location (not shown)) in the meantime.

Figure 9B:
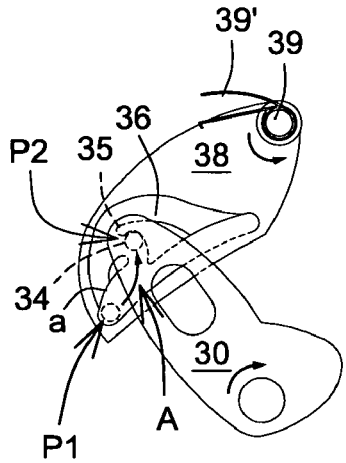
Figure 9C:
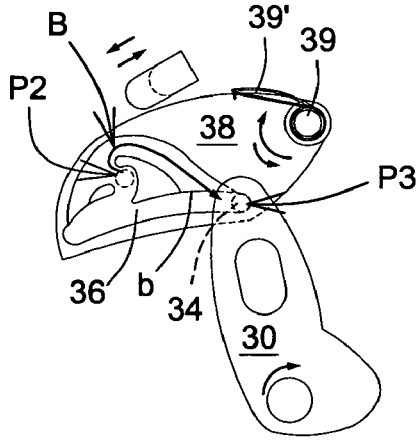
Figure 9D:
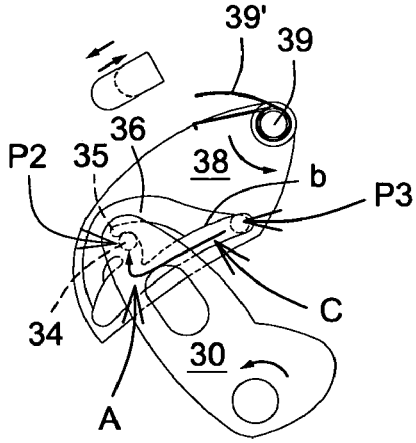
Figure 9E:
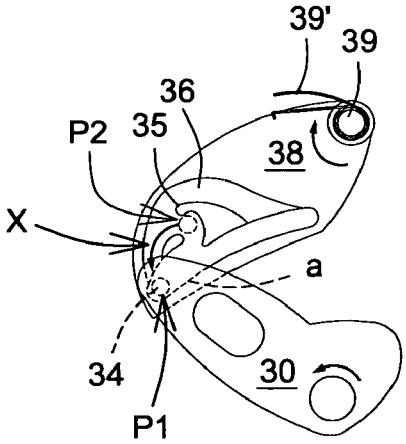

When required for operation, the cleaning tool mounting probe 18 is removed from the docking station 20 thus releasing the rocker arm 30 which pivots in a clockwise direction as viewed in the figures under the action of the torsion spring 27 acting on the stub shaft 44 to move it along the slot 33 of the rocker arm 30. FIG. 5 shows the position of the rocker arm 30 following clearance of the probe 18 from the station 20. The rotational movement of the rocker arm 30 causes the follower pin 34 to move along the primary section A of the track 36 to the 'off/standby' position P2 along the arrow of FIG. 9*b*. The pin 34 remains at that position P2 under the action of both the torsion spring 27 and the track torsion spring 39' and because of the protrusion lip 35 formed by the shape of the track 36. At this point if the probe 18 were to be re-introduced to the docking station, the rocker arm 30 would rotate anti-clockwise to bring the follower pin 34 along a return section X of the track back to the 'off' position shown at P1 along the arrow of FIG. 9. The return section X of the track 36 is contoured outwardly of the track plate 38 to give a step 'a' adjacent P1 whereby the pin 34 is locked in that position P1 with respect to the section X. In other words the pin 34 can only pass along section X in a downwards direction to the 'off' position P1.

When it is desired to commence vacuuming, the push button 22 is depressed which causes the push rod 54 to move inwardly toward the plate 24 and have its lower surface 55 pushing on the guide arm 40 in a clockwise direction within the housing 10 about the pivot 42 and the rocker arm 30 in a anti-clockwise direction. Such movement allows the follower pin 34 to pass the lip 35 and flip into the secondary section B of the track 36 towards the 'on' position P3 along the arrow of FIG. 9*c*. The section B of the track 36 is contoured outwardly toward the position P3 to provide a step 'b' to ensure that once engaged at that position, reverse movement along the section B is prevented by the step so formed. FIG. 7 illustrates the 'on' position and shows that the bent portion 29' of the contact arm 29 is seated within the recess 46 on the guide arm 40 to contact the electrically conductive torsion spring 27 and electrically close the circuit between the terminals 26 and 28, thus giving power to the vacuum generating unit of the central vacuum cleaning system.

Figure 9F:
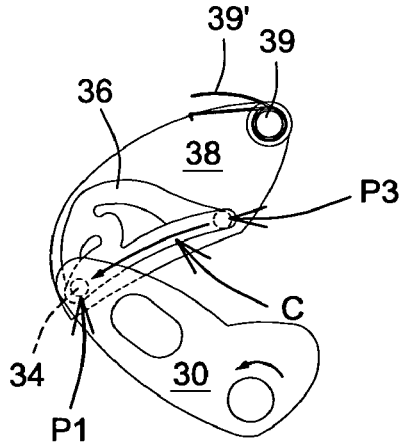

Cessation of the vacuuming activity may be achieved by reinserting the probe 18 into the docking station 20 which causes the rocker arm 30 to rotate in an anti-clockwise direction and to take the pin 34 into the 'off' position' at P1 along the arrow of FIG. 9*f* along a tertiary section C of the track 36. The probe 18 is typically held within the docking station by friction. In the alternative, the re-depression of the push button 22 effects rotation of the guide arm 40 in a clockwise direction, and the rocker arm 30 in an anti-clockwise direction, and allows the follower pin 34 to pass partially along section C but then to pass into position P2 under the action of the bias provided by the track torsion spring 39' along primary section A to the 'off/standby' position along the arrow of FIG. 9*d*. Both actions cause the contact release of the bent portion 29' of the contact arm 29 from the torsion spring 27 adjacent the recess 46 in the guide arm 40, thus cutting off electrical power to the vacuum unit in the central system.

This dual possibility for cutting power is a valuable safety feature which can be triggered speedily when needed.

The externally mounted auxiliary device of the present invention thus presents a useful addition to a central vacuum cleaning system providing a location specific means of local cleaning without the need to have a station permanently mounted within the wall of the premises. Furthermore, the use of a relatively short length of flexible concertina hose makes the cleaning task less onerous than with the conventional systems employing hoses of considerable length and bulk making it unwieldy and time-consuming to operate.

It will be understood that the device may be deployed ab initio in the installation of a central vacuum cleaning system or may be retrofitted to an existing system with suitable modifications at the inlets thereof.

It will further be appreciated that the device per se may be enclosed within a cabinet in order to confer an aesthetic quality thereto.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. An auxiliary vacuum device for a central vacuum cleaning system for premises defining areas of occupancy, said system including an electrically powered vacuum generating unit, a system network of piping extending throughout the premises and terminating in at least one inlet formed in one of the walls defining at least some of the areas of occupancy, the device comprising a housing for registration with an inlet extending through a mounting plate of the system network, the housing being adapted for installation at the inlet mounting plate externally of a wall and being provided with an inlet port for communication with said inlet, a connection exterior to the housing, a pipe extending within the housing from the inlet port to said connection, a flexible concertina hose attached to the connection proximal to the housing, a cleaning tool mounting probe provided on the hose distal from the connection, a docking station in the housing for the cleaning tool mounting probe, and switch mechanism located within the housing and adapted for activating and de-activating the electrically powered vacuum generating unit of the central vacuum cleaning system.

2. A device according to claim 1 wherein the docking station is provided with a contact member forming part of the switch mechanism and adapted for interaction as between the cleaning tool mounting probe and another part of the switch mechanism whereby in use removal of the probe initiates a first phase of activation of the vacuum generating unit of the central vacuum cleaning system and re-insertion of the probe causes de-activation of the unit.

3. A device according to claim 2 wherein the contact member is a cam provided on a pivotally mounted rocker arm.

4. A device according to claim 3 wherein the housing has a back plate and the pivotal mounting of the rocker arm is secured to the said back plate.

5. A device according to claim 4 wherein the rocker arm is provided with a slot and is provided with a follower pin.

6. A device according to claim 5 wherein a guide arm is pivotally mounted on the back plate and carries a stub shaft engaged within the slot of the rocker arm, the guide arm further having an abutment and a recess on one edge thereof.

7. A device according to claim 6 wherein a pivot of the guide arm is received in an insulated bush mounting.

8. A device according to claim 7 wherein the back plate of the housing is provided with two electrical terminals.

9. A device according to claim 8 wherein a torsion spring extends from one said electrical terminal and is reeved around a mounting and terminates in contact with the abutment, said torsion spring biasing said guide arm in a direction toward enabling the torsion spring to get into contact with the other said electrical terminal.

10. A device according to claim 9 wherein the other said terminal is provided with a contact arm with a bent portions for engagement in use with the recess on the guide arm.

11. A device according to claim 10 wherein a track plate is mounted on the back plate of the housing, the track plate having a track formed on the face thereof to define a path for the travel of the follower pin, the path having a number of sections and a number of positions therealong respectively defining 'off', 'off/standby' and 'on' positions for activating the device.

12. A device according to claim 11 wherein the track has a floor contoured over part of its length to provide a number of steps adjacent at least some of the positions to ensure proper movement of the follower pin along predetermined sections of the track.

13. A device according to claim 12 wherein the track plate is biased in a direction allowing the follower pin to move along predetermined said sections of the track toward said 'off/standby' position.

14. A device according to claim 13 wherein an on/off push button is provided and comprises a swing cover operable against a push rod spring loaded within a casing, the push rod having a contoured surface for selective contact with the guide arm to allow the follower pin to be displaced along the track between the 'off/standby' and the 'on' positions.

15. A device according to claim 14 wherein the on/off push button is operable in use to start or stop the vacuum-generating unit of the central vacuum cleaning system independently of the docking of the cleaning tool mounting probe in the docking station.

* * * * *